United States Patent [19]

Louis

[11] Patent Number: 4,732,510

[45] Date of Patent: Mar. 22, 1988

[54] PROCESS FOR DRIVING AND CEMENTING IN GROUND ANCHORS, APPARATUS AND ANCHOR BARS FOR SAID PROCESS

[76] Inventor: Claude C. Louis, 40 Bis, avenue Bosquet, 75007 Paris, France

[21] Appl. No.: 31,171

[22] Filed: Mar. 26, 1987

Related U.S. Application Data

[63] Continuation of Ser. No. 703,477, Feb. 20, 1985, abandoned.

[30] Foreign Application Priority Data

Feb. 23, 1984 [FR] France ..... 84 02742

[51] Int. Cl.[4] ..... E02D 5/80; E02D 7/26

[52] U.S. Cl. ..... 405/269; 405/262; 405/260; 405/236; 405/232

[58] Field of Search ..... 405/232, 236, 260, 262, 405/269

[56] References Cited

U.S. PATENT DOCUMENTS

| | | | |
|---|---|---|---|
| 3,222,873 | 12/1965 | Williams . | |
| 3,371,494 | 3/1968 | Lagerstrom | 405/260 |
| 3,377,807 | 4/1968 | Nave . | |
| 3,808,820 | 5/1974 | Bodine | 405/232 |
| 4,029,158 | 6/1977 | Gerrish | 405/232 |
| 4,257,722 | 3/1981 | Nakajima | 405/232 X |

FOREIGN PATENT DOCUMENTS

| | | | |
|---|---|---|---|
| 1542544 | 10/1968 | France . | |
| 2335319 | 7/1977 | France . | |
| 2367183 | 5/1978 | France . | |
| 2502208 | 9/1982 | France | 405/260 |
| 2541703 | 8/1984 | France . | |
| 0036214 | 2/1982 | Japan | 405/260 |
| 902687 | 8/1962 | United Kingdom . | |

*Primary Examiner*—Alan Cohan
*Assistant Examiner*—John Rivell
*Attorney, Agent, or Firm*—Larson and Taylor

[57] ABSTRACT

Process using a ground anchor (1) with a longitudinal hole (7), on which is fitted an interface device (12) comprising a cylinder containing a chamber connected to the said hole (7); a grout is pumped under pressure to the tip (6) of the hole in the ground; the cylinder is struck mechanically, and transmits the mechanical shock wave to the ground anchor. The grout injected is a liquid mix (L); the grout is injected by means of a pump (21) at a pressure greater than 20 MPa; the grouting pressure is sufficient to fragment the ground by means of the injected grout, and the cylinder is struck by a percussion/vibration hammer (2) at a frequency greater than 10 Hz.

14 Claims, 6 Drawing Figures

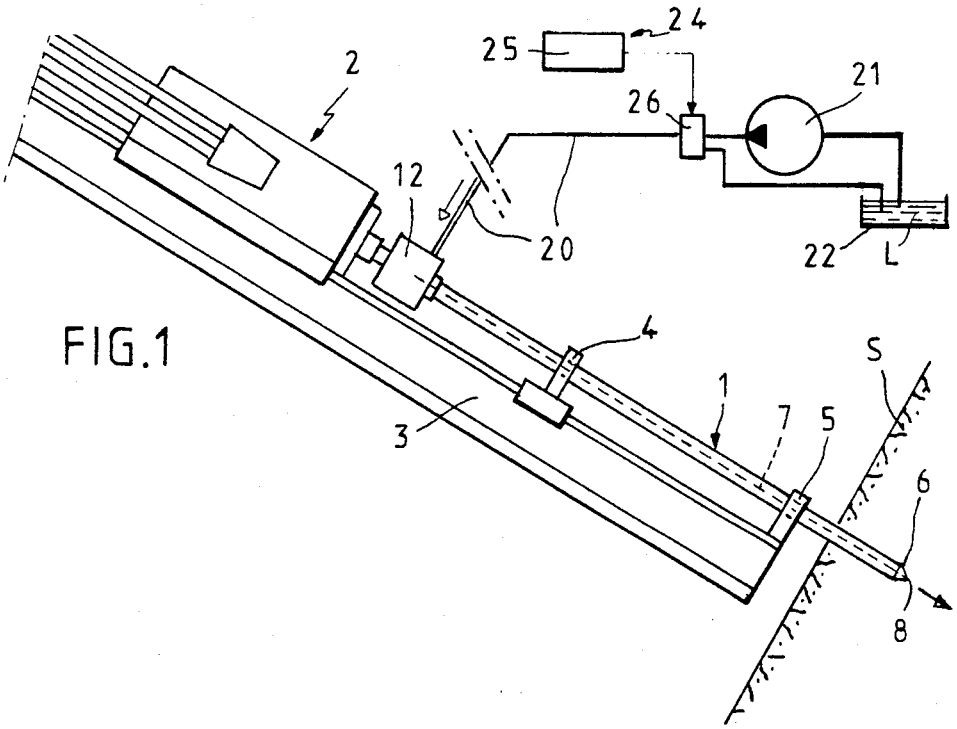
FIG.1
FIG. 2
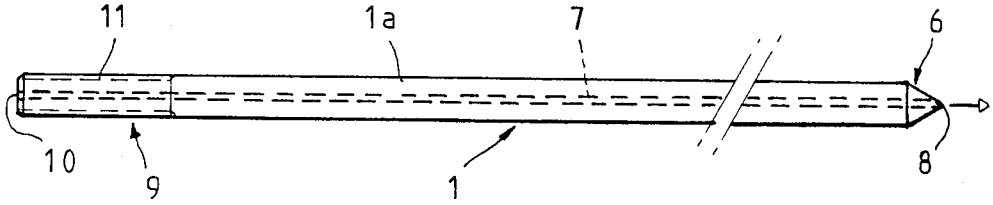

FIG.5
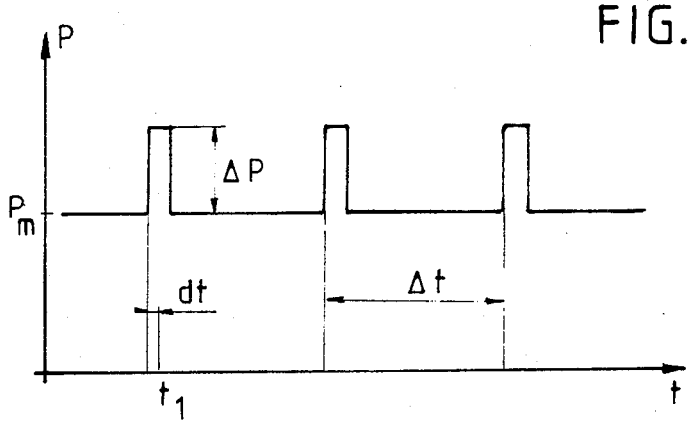
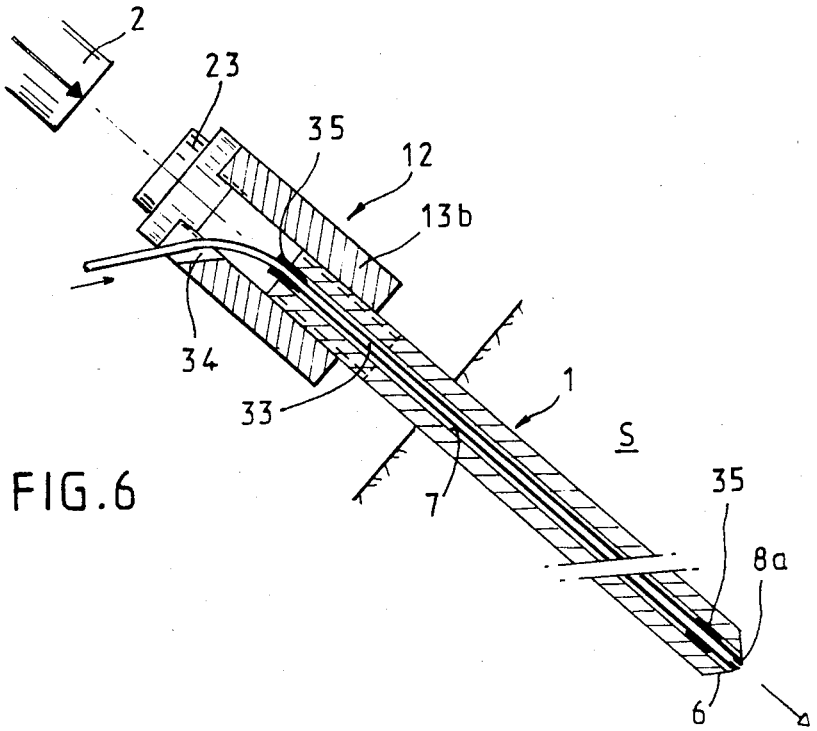
FIG.6

PROCESS FOR DRIVING AND CEMENTING IN GROUND ANCHORS, APPARATUS AND ANCHOR BARS FOR SAID PROCESS

This application is a continuation of application Ser. No. 703,477 filed Feb. 20, 1985, now abandoned.

The invention concerns a process for driving and cementing in a ground anchor, making use of an anchor bar with a longitudinal hole open at the remote (i.e., front) end; at the other end of this rod is mounted an interface device comprising a cylinder forming a dolly in the shape of a chamber communicating with the longitudinal hole in the anchor rod; a special grout under pressure is pumped to the end of the hole in the ground, and a hammer or similar device hits the cylinder which transmits the mechanical impact to the anchor rod.

A process of this type is known and described for example in Patent GB No. 902 687. However, the equipment for and efficiency of this process requires improvement.

The main purpose of the invention is to render the process of the type hereinabove defined such that it can better meet the various requirements of practical engineering, and especially such that its performance is significantly improved and the practical application of the process is simplified.

By this invention, a process for driving and cementing in a ground anchor of the type hereinabove described is characterized by the fact that the substance for cementing in the anchor is a liquid grout, that this liquid grout is pumped under pressure in such a way that the static pressure of the liquid is greater than 20 MPa (200 bars) and that the kinematic energy of the grout leaving the hole at the remote end of the anchor rod is sufficiently high to cause a hydraulic fracturing of the ground, and that the cylinder is hit with a percussion/vibration hammer at a sufficiently high frequency to prevent the ground reforming between successive impacts, this frequency being higher than 10 Hz.

The viscosity of the liquid grout is generally less than 100 centipoises and preferably less than 20 centipoises.

Preferably, the impact frequency should be of the order of 50 Hz, and especially around 70 Hz.

The static inlet pressure of the liquid entering the cylinder chamber is beneficially of the order of 80 MPa (800 bars), and especially of the order of 100 MPa (1000 bars).

These high pressures are such that the grout leaving the longitudinal hole in the anchor bar, forming a nozzle, has a very high kinematic energy (supersonic speeds) capable of fragmenting the ground.

By proceeding in the manner prescribed in the procedure hereinabove described, the anchor bars penetrate the ground easily and quickly because of the breaking-up of the ground under the cutting effect of the very high velocity fluid jet. The grout can have a cement or resin base, or other type of base; in the case of a cement base grout, if c designates the weight of cement in the mix and e the weight of water, the mix may be characterized by a c/e ratio of or around 1.

Preferably, the short increases in the pump discharge pressure should be controlled, and the mechanical impacts on the anchor rod should be synchronized with these pressure increases.

A tube, e.g., a semi-rigid tube, may be fitted in the longitudinal hole in the anchor rod, but separate therefrom, and running through a side passage in the cylinder forming the dolly, this tube being connected directly to the pump, and having a nozzle at the remote end of the anchor rod.

The invention also concerns a device for implementing a process as hereinabove defined, this device comprising an anchor rod with a longitudinal hole open at its remote end in the ground, an interface device comprising a cylinder forming a dolly and a chamber communicating with the said longitudinal hole in the anchor rod, the said cylinder being connected rigidly to the head of the anchor rod, with means for injecting into the ground, at the remote end of the anchor rod, a cementing material under pressure, and means for hitting the cylinder which mechanically transmits the impact to the anchor rod; under this invention, the device is characterized by the fact that the means for injecting the grout in the chamber include pumping equipment such that the static pressure of the liquid is greater than 20 MPa (200 bars) and the means for hitting the piston include a percussion/vibration hammer machine, mounted on a slide frame, designed to operate at a sufficient frequency to prevent the ground reforming between successive impacts and intergranular friction remobilizing, and especially a frequency higher than 10 Hz, the grout being a liquid grout.

Preferably, the controls are designed to produce short increases in the pump discharge pressure, the frequency and timing of the mechanical impacts being controlled with reference to these short increases in the discharge pressure.

The invention also includes a type of anchor rod for use with the procedure hereinabove described, this anchor rod comprising a longitudinal hole open at its remote end in the ground, characterized by the fact that the diameter of this hole or of a tube inside this hole at the remote end is relatively small so that the hole acts as a nozzle, this diameter being of the order of a few millimeters, and more especially of the order of 1–2 millimeters.

In addition to the devices hereinabove described, the invention also comprises certain other arrangements that are described in detail hereinunder in connection with the special practical features described with reference to the drawings appended hereto but which are not exhaustive.

FIG. 1 of these drawings is a schematic representation of a system complying with the invention as described.

FIG. 2 is a plan view of the anchor bar.

FIG. 5 is a diagram illustrating the increases in pump discharge pressure.

FIG. 6 illustrates an alternative type of construction.

Figure 3:
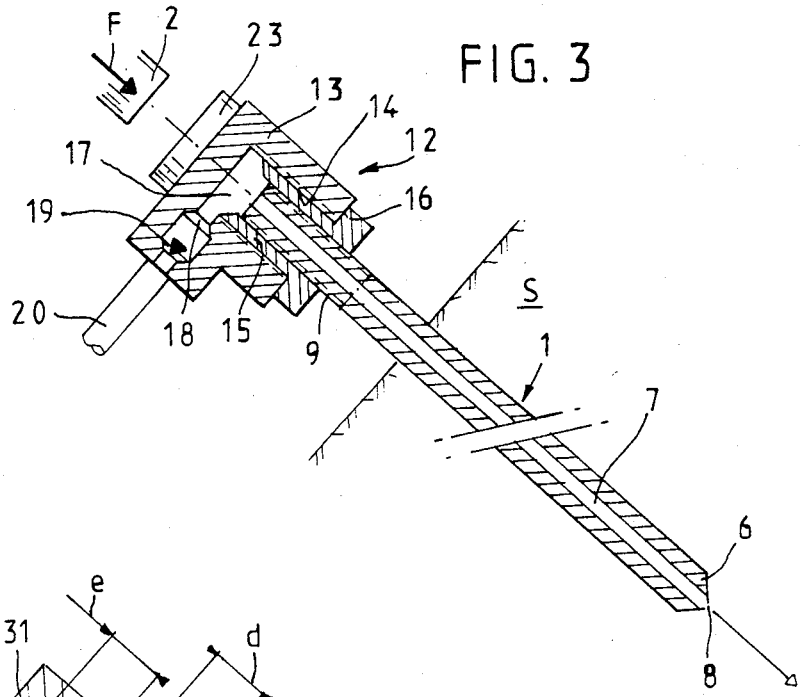
FIG. 3 is a schematic view, at a larger scale, of a detail of the device shown in FIG. 1.

These figures, especially FIG. 1, show a device for driving and cementing in ground anchors 1 in the ground S.

The device comprises a high performance pneumatic, hydraulic or other type of percussion/vibration machine 2. This machine 2 is mounted on the slide frame 3 comprising a moving guide 4 and a stationary guide 5 maintaining in position the anchor rod 1 to be driven into the ground S while allowing it to slide in the longitudinal direction. The whole unit comprising the slide 3 and machine 2, with the anchor rod 1 to be driven into the ground S can be set up at any desired angle, and the surface of the ground to be treated S can also be at any angle. The slide 3 and the other parts and devices mounted thereon can be supported by the boom of a hydraulic shovel or similar machine.

The percussion/vibration machine 2 or vibration driver is designed to operate at a sufficient frequency to liquify certain soils (e.g., sands) and prevent the ground reforming around the tip 6 of the anchor rod, between two successive impacts. This significantly reduces skin friction. This frequency is especially greater than 10 Hz and preferably of the order of 50 Hz and more especially approximately 70 Hz.

The anchor rod 1 has a longitudinal hole 7 open at the remote end 8 in the point 6, ie, at the remote end of the anchor rod penetrating deepest into the ground. This opening 8 can be arranged to form a nozzle, i.e., to have a reduced diameter, especially of the order of a few millimeters, and preferably of the order of 2 millimeters. The longitudinal hole 7 also opens at the other end 9 of the rod 1 at opening 10. There are no radial openings between the hole 7 and the outer surface of the rod, over the whole length of the wall surrounding the hole between openings 8 and 10. When the grout is injected through opening 10, it can only emerge through opening 8. The end 9 of the anchor rod which, after completion, stands proud of the ground surface, is provided with the desired fastenings, for example a screw thread 11 for an interface device 12 (FIGS. 1, 3, 4) or dolly. The rod 1 can consist of several lengths joined end-to-end.

The rods to be percussion-vibrated and grouted into the ground, according to the invention, therefore comprise essentially:

a special head 9 with means for attaching the dolly 12 transmitting the driving forces. This head 9 is also provided with a screw thread or other type of fastening to enable other parts to be fitted to the ground anchor once in place;

the anchor rod proper designated 1*a* consisting essentially of a steel section of suitable shape (cruciform, tube, rod with external envelope), to provide the longitudinal hole 7 through which the percussion/vibration fluid can flow.

The tip 6 provides the jet to fragment the ground mechanically. The geometry of tip 6, which may be of larger diameter than the rod, and may be provided with cutting edges (means for mechanically cutting rod) is designed for the best penetration of rod 1 into the ground.

The interface device 12 comprises a cylinder 13 (FIG. 3) attached to end 9 of rod 1. The attachment is made, as shown for example in FIG. 3, by providing the cylinder 13 with a tapped hole 14 for screwing onto the outside screw thread of a sleeve 15 itself having a tapped hole for screwing onto the threaded end 11 of rod 1. The sleeve 15 may have an external shoulder 16 against which cylinder 13 abuts axially. A chamber 17 is provided inside cylinder 13, this chamber 17 being coaxial with rod 1 when cylinder 13 is fitted on the said rod. This chamber 17 communicates directly with the longitudinal hole 7 in rod 1. Seals are provided between the rod and the sleeve 15 and between the sleeve 15 and the cylinder 13. Chamber 17 is connected by a port 18 with a check valve 19 to a pipe 20 connected to the discharge of a pump 21 (FIG. 1) capable of injecting the grout in reservoir 22 into chamber 17 at high pressure.

The static pressure of the grout entering chamber 17, provided by pump 21, is greater than 20 MPa (200 bars), preferably greater than 50 MPa (500 bars) and beneficially of the order of 80 MPa (800 bars) to 100 MPa (1000 bars). Check valve 19 opens in a direction enabling the grout to enter chamber 17 from discharge pipe 20 but closes to prevent flow in the opposite direction.

The grout is a liquid grout L whose viscosity is generally less than 100 centipoises and preferably less than 20 centipoises.

The grout L is a mix based on cement, resin or other material. In the case of a cement-based grout, if the weight of cement in the mix is designated c and the weight of water is designated e a suitable mix for the procedure in the invention is characterized by a c/e ratio of approximately 1.

In the type of construction illustrated in FIG. 3, the top end of cylinder 13 has a boss forming a helmet 23 which is struck directly by the hammer 2 shown schematically. As shown on FIG. 1, the assembly is combined with means 24 of controlling the short pressure increases on the discharge from pump 21 and the mecahnical impacts on rod 1 from hammer 2 are synchronized with these increases in pressure.

FIG. 5 is a schematic diagram of pump 21 discharge pressure P which is the pressure in discharge pipe 20 as a function of time t on the abscissa. At time intervals $\Delta t$, representing the period, the discharge pressure is suddenly increased $\Delta P$ for a relatively short time before returning to its means value Pm. The pressure change $\Delta P$ controlled by device 24 can be of the order of 50% of the value of Pm. This sudden increase produces hydraulic shock waves which are transmitted to the tip 6 of rod 1. As stated above, Pm is greater than 20 MPa.

The parameters of the system are selected such that the hydraulic shock wave arrives at tip 6 at the remote end of the rod at practically the same time, but slightly before the mechanical shock wave produced by the impact of hammer 2 on helmet 23. The term "slightly before" is understood to mean that the time interval between the arrival of the hydraulic shock wave at tip 6 of the rod and the arrival of the mechanical shock wave is less than one-tenth and preferably less than one-hundredth of the period of the hammer blows from hammer 2. This period is set by means of the mechanism controlling hammer 2, so that it is equal to $\Delta t$, this period being selected so as to have a frequency greater than 10 Hz.

The timing of the impact as compared with the pressure rise $\Delta P$ is adjusted so that the condition hereinabove described is satisfied, with allowance for the fact that the mechanical shock wave, is transmitted through rod 1 at a velocity of the order of 5500 m/s, whereas the hydraulic shock wave is transmitted through the liquid in the longitudinal hole 7 at a lower velocity, of the order of 1500 m/s. In other words, if the pressure rise $\Delta P$ occurs at time tl, the mechanical impact on helmet 23 must occur at time tl+dt.

The controls 24 can include a control 24 for setting a pressure limiter 26 fitted to the pump 21 discharge pipe, so as to obtain the diagram shown in FIG. 5.

In this way, the intergranular effective stresses in the ground are reduced and even completely cancelled out, so that penetration of tip 6 and rod 1 is significantly improved.

As a non-limiting example, the impact energy of hammer 2 is 300 to 400 joules per blow.

Figure 4:
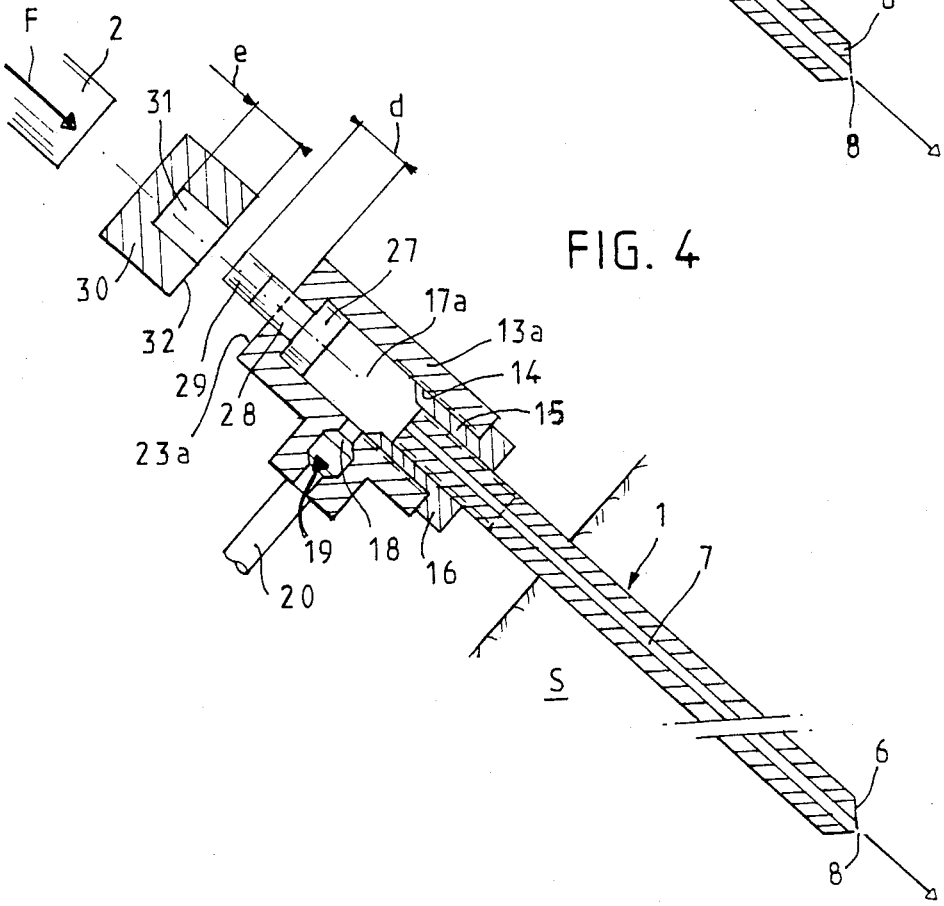
FIG. 4 is a schematic view showing an alternative type of construction for the device shown in FIG. 3.

FIG. 4 illustrates an alternative type of construction in which the axial lengths of cylinder 13*a* and chamber 17*a* are significantly greater than those in the alternative shown in FIG. 3 in order to provide for a piston 27 to slide, without leakage, in chamber 17*a*. Parts that are similar to or serve the same purpose as the corresponding parts already described with reference to FIGS. 1 and 3 are designated by the same numbers, without repeating the description.

Piston 27 has a rod emerging through part 28, with means of extending it such as the part designated 29, whose length is chosen to suit working conditions and to adjust the parameters to obtain the best performance. The method of connecting part 28 to part(s) 29 can make use of any appropriate system such as screw threads, lugs, etc.

In one conceivable design, hammer 2 strikes, in the direction of arrow F, directly on extension 29. The impact first causes piston 27 to slide down cylinder 13*a* and increase the pressure of the grout, and then hammer 2 hits the top 23*a* of cylinder 13*a;* the impact is then transmitted mechanically through cylinder 13*a* to rod 1 connected rigidly to this cylinder.

The parameters of this device, especially the distance d determining the stroke of piston 27 before hammer 2 strikes end 23*a*, are chosen and adjusted such that the hydraulic shock wave, produced by the travel of piston 27 in cylinder 17*a*, reaches tip 6 of the rod at practically the same time, but slightly before (in the sense hereinabove defined), as the mechanical shock wave.

The hydraulic shock wave produced by the travel of piston 27 can be used independently of or in combination with the controlled changes ΔP in the pump 21 discharge pressure.

If it is desired not to use the effect of piston 27, in the type of construction illustrated in FIG. 4, part 28 of the piston rod and its extension 29 can be covered by means of a cover 30, which might be steel, having a blind hole 31 whose axial length is chosen to suit the desired reduction in the effect of piston 27. If the axial length e of this blind hole 31 is greater than the length d of the projecting part of the piston rod when the piston 27 is at the top end of its travel, then face 32 of the cover will bear on end 23*a* without the bottom of hole 31 touching extension 29. In this case, the impact from hammer 2 on the cover 30 will be directly transmitted to cylinder 13*a* and the piston 27 will have no effect. If the distance e is less than d, the effect of the piston 27 will be partially reduced and the stroke of the piston will be equal to d–e.

In the type of construction illustrated in FIG. 4 therefore, the effect of piston 27 can be adjusted as desired, by altering the length of extensions 29 and the depth e of the cover 30, if used.

The interface device 12 or dolly is therefore a complex part which, in addition to transmitting the mechanical and hydraulic energies used in driving the anchor rod, must be capable of providing the correct synchronization between the mechanical and hydraulic shock waves.

Another alternative illustrated in FIG. 6 and forming an integral part of this inventin consists of producing the jet cutting effect as follows. A tube 33, such as a smi-rigid tube for example, is inserted in longitudinal hole 7 but separate from rod 1. This tube 33 runs through cylinder 13*b* of the interface device 12 through a side port 34 and is connected directly to the pump, not shown on FIG. 6. The end of tube 33 ends level with the point of tip 6; tube 33 can be held coaxially in rod 1 by means of sleeves 35, which may be flexible material, forced into hole 7. A nozzle 8*a*, whose characteristics, including its diameter, are similar to those of nozzle 8 already described, is fitted at the end of tube 33, near tip 6. This alternative has the advantage of reducing the cost of rod 1, which is left in the ground, and of considerably simplifying the dolly device 12. Nozzle 8*a* is also recovered after completion, simply by withdrawing flexible tube 33 and maintaining the pressure inside.

With this type of construction, a rod 1 is sunk and cemented into ground S as follows.

The interface device 12 is fitted to end 9 of the anchor rod, and the interface is connected to pipe 20 (FIGS. 1, 3, 4) by means of a high pressure flexible hose. Rod 1 is then inserted into guides 4 and 5 carried on the slide frame 3.

The slide frame 3, hammer 2 and rod 1 are then set up at the required angle to the ground, so that the anchor is driven in the required direction.

Pump 21 is then started to inject the grout into chamber 17 or 17*a* and the percussion/vibration machine 2 is started to hit cylinder 13 or piston 27 and cylinder 13*a*.

The grout injection pressure, which is the combination of the static pressure of the liquid pumped into the chamber and the dynamic pressure caused by the controlled pressure changes ΔP and/or by the action of the piston is sufficient to cause the liquid injected under pressure to fragment the ground.

When the pump 21 discharge pressure varies as shown in FIG. 5, the frequency and timing of hammer 2 is adjusted to obtain optimum performance.

In the arrangement illustrated in FIG. 6, tube 33 is connected directly to pump 21 (not shown). The pump discharge pressure can be controlled as illustrated in FIG. 5, and the timing of hammer 2 is adjusted as explained hereinabove.

The very high pressure jet of fluid emerging from nozzle 8 or 8*a* at the tip 6 of the rod serves to perforate the soil or rock by means of the very high velocity fluid, and to cement in the rod.

The fluid injected has the property of being very thin for jet cutting into the soil or rock, but subsequently to set after a certain time, to cement in rod 1 and consolidate the surrounding ground when driving is complete.

The interface device 12 at the head of rod 1 serves three purposes:

(a) It transmits the mechanical energy from hammer 2 to rod 1;

(b) It transmits the static pressure from pump 21 for the jet cutting and cementing fluid;

(c) It converts part of the mechanical energy from the hammer into a dynamic excess pressure improving the driving process. This dynamic excess pressure is cumulative with the pump static pressure and thus helps in fragmenting the ground and reducing intergranular effective stresses. This double effect significantly improves penetration of the anchor rod as well as the impregnation and diffusion of the grout in the ground for the purposes of consolidating the ground and cementing in the rod when it sets and hardens.

The action of the very high pressure jet of fluid serves to break up the ground under the impact of this jet of fluid emerging at very high velocity.

Injecting the grout at high pressure enables it to penetrate the surrounding ground radially for a significant distance. The result is good lateral consolidation by reason of the bulb of grout whose diameter can exceed 40 cm.

The anchor rods 1 can have a variable cross-sectional shape, increasing from the tip towards end 9. For example, the cross-sectional area may increase by 10% to 30% per unit length, for example per 4 m length.

I claim:

1. Process for driving and cementing anchors in ground comprising the steps of:

taking an anchor rod with a longitudinal duct open at a tip located at the remote end of the rod in the ground, taking an interface device connected at the other end of the rod, said interface device comprising a cylinder acting as a dolly and having a top end which forms a helmet, said cylinder containing a chamber communicating with the longitudinal duct of the rod, taking a grout sufficiently liquid to be pumped at high pressure, and, taking a high-pressure pump for puming and ejecting said liquid grout through said longitudinal duct so that the kinetic energy of the grout emerging from the duct through the tip of the rod is high enough to produce hydraulic fracturing of the ground, and using a percussion/vibration hammer or the like to strike the helmet of the cylinder to mechanically transmit its energy of impact to the rod and hence to the ground as a mechanical shock wave, wherein the hammer strikes at a frequency that is sufficient to prevent the ground reforming between successive impacts, which frequency is greater than 10 Hz.

2. Process according to claim 1, characterized in that the viscosity of the liquid grout is less than 100 centipoises and, preferably less than 20 centipoises.

3. Process according to claim 1, characterized in that the frequency of the hammer blows is of the order of 50 Hz and especially approximately 70 Hz.

4. Process according to claim 1, characterized in that the inlet pressure of the liquid entering the cylinder chamber is of the order of 80 MPa, and especially of the order of 100 MPa.

5. Process according to claim 1, characterized in that the grout is a cement-based grout with a water/cement ratio of or around 1, with the water and cement both measured by weight.

6. Process according to claim 1, characterized in that there are short increases ($\Delta P$) in the pump (21) discharge pressure and that the hammer blows on the rod are synchronized with these pressure increases.

7. Process according to claim 1, characterized in that the longitudinal duct (7) in the rod (1) contains a tube (33), which may be semi-rigid, separate from the said rod, and emerging from said cylinder (**13*b*) forming the dolly through a side port (34), the said tube being connected directly to said pump and its other end reaching the tip (6) of the anchor rod with a nozzle (8*a***).

8. Process according to claim 1, in which a hydraulic shock wave is produced, characterized in that the parameters of the system are chosen in such a way that the hydraulic shock wave arrives at the tip (6) of the rod in the ground practically at the same time as, but slightly before the mechanical shock wave.

9. Ground anchor for use with a process according to claim 1, consisting of an anchor rod with a longitudinal hole open at its remote end in the ground, characterized in that the diameter of the open end (**8, 8*a*) of the hole (7) or a tube (33) inside the hole (7) is relatively small so that the hole (8, 8*a***) acts as a nozzle, this diameter being of the order of a few millimeters, and especially of the order of 2 millimeters.

10. A process according to claim 1 in which the static pressure of the liquid pumped by the high-pressure pump is greater than 20 MPa.

11. A process according to claim 1, further comprising injecting the liquid grout at a pressure greater than 20 MPa, producing short discharge pressure increases and wherein the hammer impacts are synchronized with the pressure increases.

12. Apparatus for driving and cementing anchors in the ground, comprising:

an anchor rod with a longitudinal duct open at a tip located at the remote end of the rod in the ground, an interface device connected at the other end of the rod, said device comprising a cylinder acting as a dolly and having a top end which forms a helmet, said cylinder containing a chamber communicating with the longitudinal duct of the rod, a grout sufficiently liquid to be pumped at high pressure, a high-pressure pump for pumping and injecting said liquid grout through said longitudinal duct so that the kinetic energy of the grout emerging from the duct through the tip of the rod is high enough to produce hydraulic fracturing of the ground, and a percussion/vibration hammer to strike the helmet of the cylinder which mechanically transmits the energy of the impact to the rod, said hammer having means for striking at a frequency that is sufficient to prevent the ground reforming between successive impacts, this frequency being greater than 10 Hz.

13. Apparatus according to claim 12, characterized in that it includes controls (25) for producing short increases in the pump (21) discharge pressure, the frequency and timing of the impacts of the hammer being adjusted to suit these short increases in the discharge pressure.

14. Apparatus for driving and cementing in ground anchors using an anchor rod with a longitudinal hole open at its remote end in the ground and at the other end of which is an interface comprising a cylinder acting as a dolly and containing a chamber communicating with the longitudinal hole in the rod, said apparatus comprising pump means for pumping a liquid grout under pressure to the remote end of the rod in the ground, and hammer means for striking the cylinder to transmit mechanisally, the energy of impact to the rod, said pump means comprising means for injecting the grout at a static liquid pressure greater than 20 MPa, and said hammer means comprising means for striking the cylinder with a percussion hammer at a frequency greater than 10 Hz and sufficient to prevent the ground from reforming between successive impacts, and control means for producing short pump discharge pressure increases, and for changing the timing and frequency of the pressure increases.

* * * * *